US005701649A

United States Patent [19]

Reesor et al.

[11] Patent Number: 5,701,649

[45] Date of Patent: Dec. 30, 1997

[54] COUPLED DRAFT KEY PULLER

[75] Inventors: David Warren Reesor; David Roy Joseph Reesor, both of Calgary, Canada

[73] Assignee: Hydra-Tech International Corporation, Calgary, Canada

[21] Appl. No.: 633,075

[22] Filed: Apr. 16, 1996

[51] Int. Cl.[6] ..... B23B 19/02

[52] U.S. Cl. ..... 29/252

[58] Field of Search ..... 29/252, 237, 239, 29/263, 265, 427; 294/15, 16

[56] References Cited

U.S. PATENT DOCUMENTS

| | | |
|---|---|---|
| 2,507,003 | 5/1950 | Gagne . |
| 2,735,649 | 2/1956 | Swallert . |
| 2,797,889 | 7/1957 | Talboys . |
| 2,807,080 | 9/1957 | Mathews, Sr. . |
| 2,874,933 | 2/1959 | Feucht . |
| 3,066,913 | 12/1962 | Leeson . |
| 3,069,761 | 12/1962 | Sommer . |
| 3,744,116 | 7/1973 | Peterson . |
| 3,797,097 | 3/1974 | Peterson . |
| 3,908,258 | 9/1975 | Barty . |
| 5,129,133 | 7/1992 | Reesor . |
| 5,233,740 | 8/1993 | Chen . |

FOREIGN PATENT DOCUMENTS

| | | |
|---|---|---|
| 22682 | 7/1907 | United Kingdom . |

*Primary Examiner*—Timothy V. Eley
*Assistant Examiner*—Lee Wilson
*Attorney, Agent, or Firm*—George A. Seaby

[57] ABSTRACT

Sometimes when attempting to remove the draft key from an E-type railway car coupler, it is difficult to connect the key pulling device to the key without disconnecting the trainline. A simple key pulling device which solves this problem includes a pair of parallel hydraulic cylinders, a yoke interconnecting one end of the cylinders, piston rods extending out of such one end of the cylinders, a socket in the yoke, and separate jaws for removable mounting in the socket and for connecting the pulling device to a key, whereby the jaws can be independently mounted on the head of a key and then connected to the yoke, extension of the piston rods against the coupler causing outward movement of the cylinders, yoke and jaws to pull the key from the coupler.

4 Claims, 3 Drawing Sheets

COUPLED DRAFT KEY PULLER

BACKGROUND OF THE INVENTION

1. Field of the Invention

This invention relates to a pulling device, and in particular to a pulling device for removing a coupler draft key from a so-called E-type railway car coupler.

2. Discussion of the Prior Art

U.S. Pat. No. 5,129,133, which issued to David W. Reesor on Jul. 14, 1992 describes a simple draft key puller for removing a key of the type including a flanged head from a railway car coupler. The puller includes a pair of parallel hydraulic cylinders, a yoke interconnecting one end of the cylinders, piston rods extending out of the other end of the cylinders, a sleeve in the yoke parallel to the cylinders for receiving an elongated shaft, a latch for retaining the shaft in the sleeve, and a socket in the outer free end of the shaft for receiving the head of a key, whereby, with the shaft in the sleeve and connected to a key, extension of the piston rods against the coupler pocket pushes the cylinders and consequently the sleeve and shaft outwardly to pull the key from the coupler.

While the above described device works well, a problem arises when the trainline (the air line running from the locomotive to the rear of the train) interferes with the placing of the socket in the outer free end of the shaft on the head of a key. In many instances, the trainline passes beneath the key in close proximity thereto, making it difficult if not impossible to place the socket on the head of the key without removing the trainline.

While the patent literature includes a large number of patents relating to pulling devices having features in common with the invention described in the above-mentioned Reesor patent, none of the patents offers a solution to the problem outlined above. The literature in question includes U.S. Pat. No. 2,507,003, issued to A. Gagne on May 9, 1950; U.S. Pat. No. 2,735,649, issued to S. A. Swallert on Feb. 21, 1956; U.S. Pat. No. 2,797,889, issued to H. H. Talboys on Jul. 2, 1957; U.S. Pat. No. 2,807,080, issued to G. R. Mathews, Sr. on Sep. 24, 1957; U.S. Pat. No. 2,874,933, issued to J. E. Feucht on Feb. 24, 1959; U.S. Pat. No. 3,066,913, issued to A. E. Leeson on Dec. 4, 1962; U.S. Pat. No. 3,069,761, issued to F. Sommer on Dec. 25, 1962; U.S. Pat. No. 3,744,116, issued to B. E. Peterson on Jul. 10, 1973; U.S. Pat. No. 3,797,097, issued to B. E. Peterson on Mar. 19, 1974; U.S. Pat. No. 3,908,258, issued to T. Barty on Sep. 30, 1975 and U.S. Pat. No. 5,233,740, issued to J.-N. Chen on Aug. 10, 1993, and U.K. Patent No. 22,682, granted to Thomas Barnes on Jul. 4, 1907. In general, the patented devices include jaws or sockets for gripping an article to be pulled which are permanently affixed to the remainder of the devices. Moreover, many of the patented devices are structurally complicated, and thus expensive to mass produce.

GENERAL DESCRIPTION OF THE INVENTION

The object of the present invention is to provide a relatively simple coupler draft key puller, which can readily be connected to a key, even when an obstruction such as a trainline is present on one side of the key.

Accordingly, the present invention relates to a device for removing a draft key including a shank and a head from a railway car coupler comprising a pair of fluid actuated cylinder means; yoke means interconnecting said cylinder means for maintaining the cylinder means in permanent parallel, spaced apart relationship; piston rod means extending outwardly from said cylinder means on one side of said yoke means;-socket means in said one side of said yoke means; and separable jaw means for removable mounting in said socket means, and for receiving the head of a key, whereby the jaw means can be independently mounted on the head of a key and then placed in said socket means to connect the jaw means to said yoke means, and the piston rod means extended against the coupler to cause outward movement of said cylinder means, yoke means and jaw means to pull the key from the coupler.

BRIEF DESCRIPTION OF THE DRAWINGS

The invention is described hereinafter in greater detail with reference to the accompanying drawings, which illustrate preferred embodiments of the invention, and wherein.

DESCRIPTION OF THE PREFERRED EMBODIMENT

Figure 1:
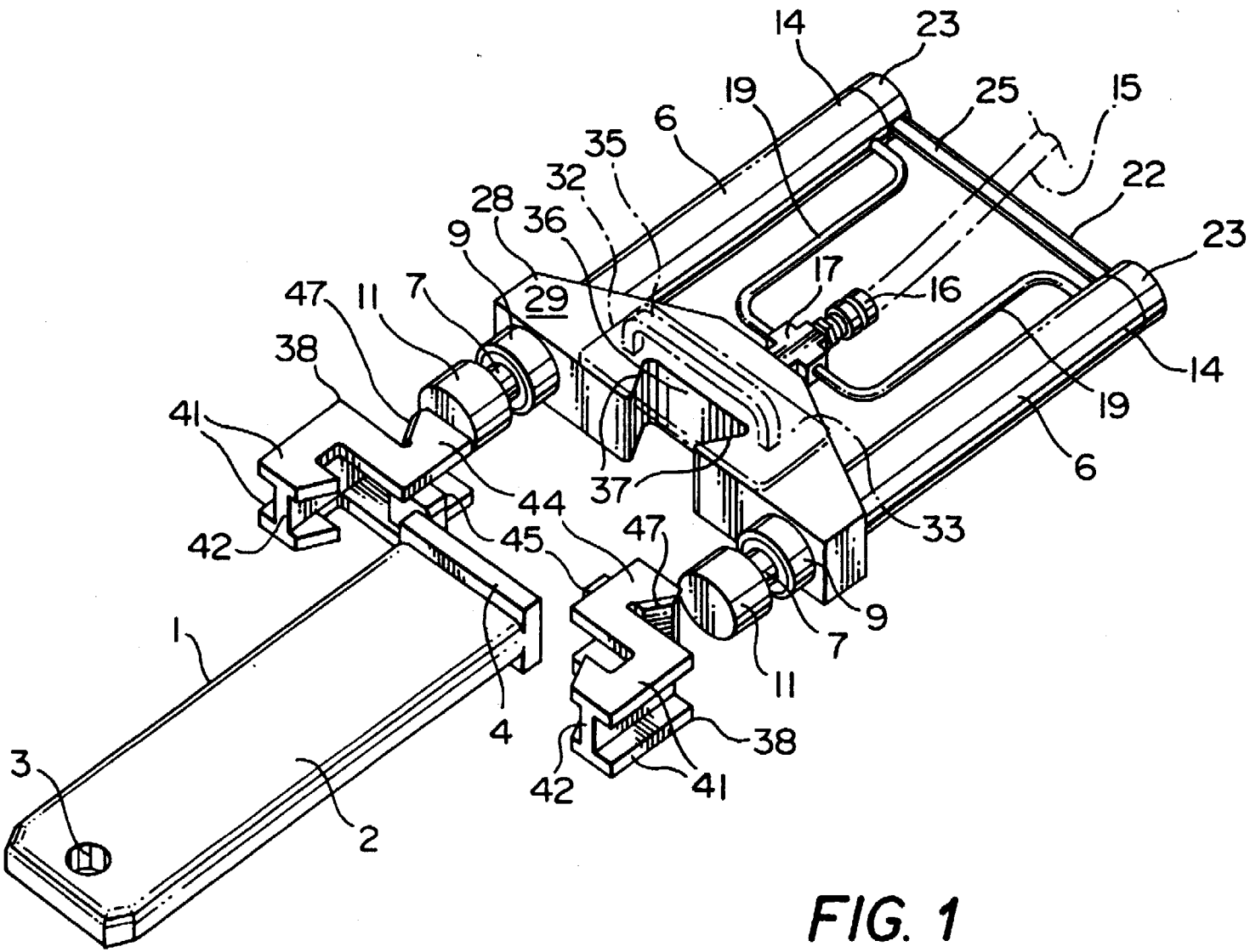
FIG. 1 is a partly exploded, isometric view of a key and a key pulling device in accordance with the invention.

It will be noted that the drawings illustrate two very similar embodiments of the invention. Accordingly, wherever possible, the same reference numerals have been used to identify the same or similar elements in the drawings.

Referring to the drawings, the device of the present invention is intended for use in removing a key 1 from a railway car coupler (not shown). The key 1 includes a generally rectangular, elongated shank 2, with a hole 3 in one end thereof for receiving a pin (not shown). A head 4 is provided on the other end of the shank 2, permitting grasping of the key 1 during insertion or removal of the key from the coupler. The head 4 is defined by a rectangular plate on the end of the shank 2.

Figure 2:
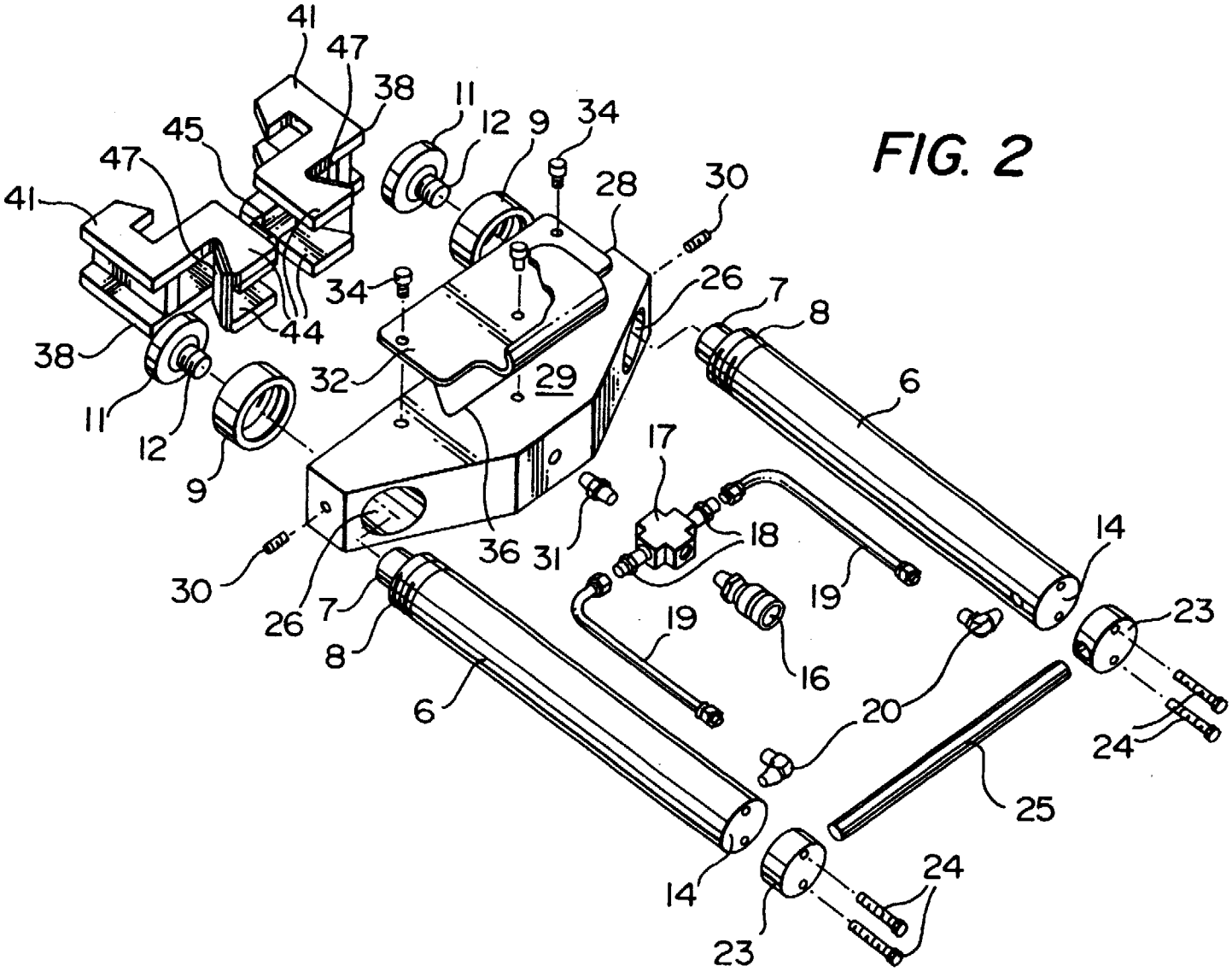
FIG. 2 is an exploded view of a second embodiment of the device of the present invention.
Figure 3:
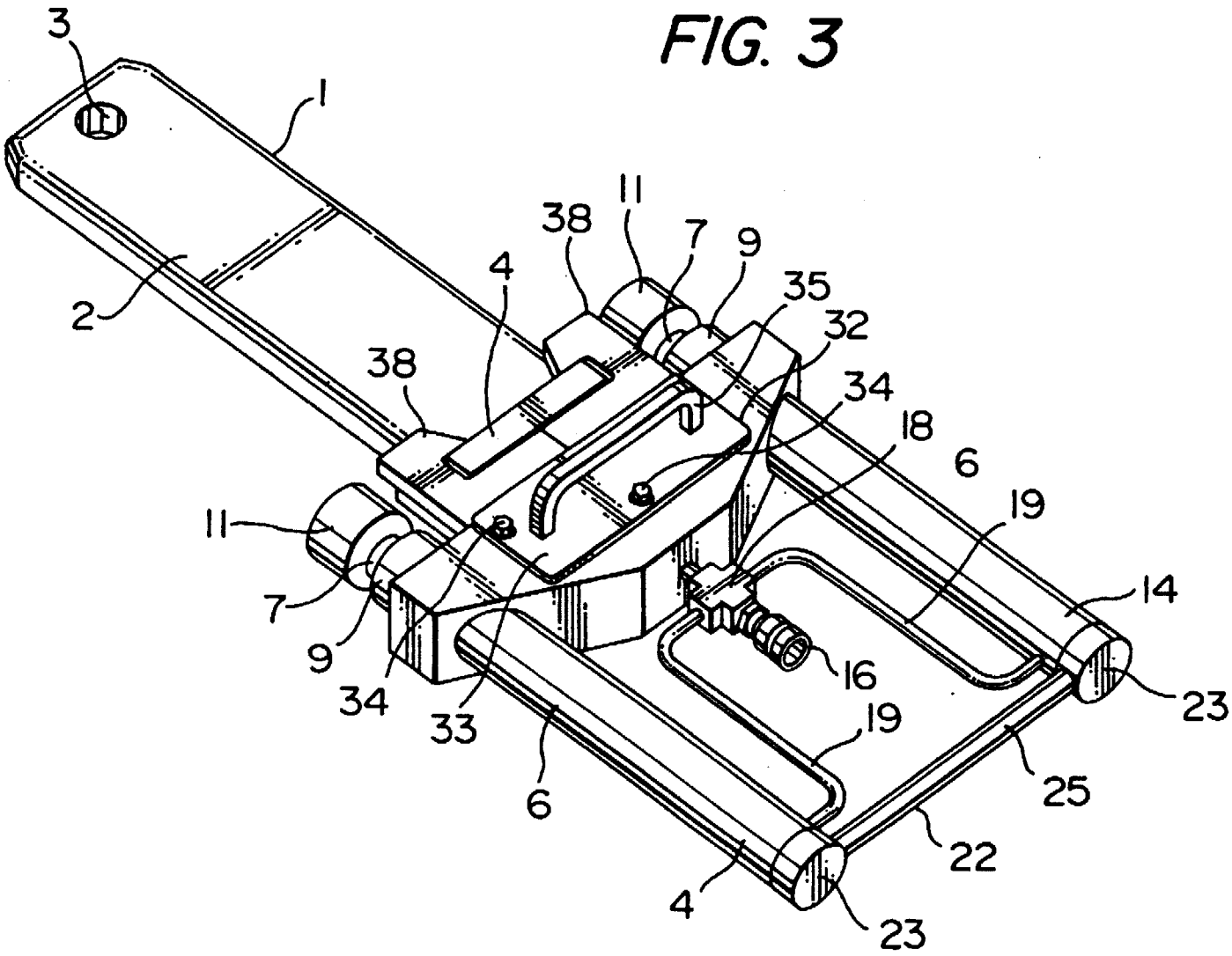
FIG. 3 is an isometric view of the device of FIG. 1 connected to a draft key.

The key pulling device in accordance with this invention includes a pair of hydraulic cylinders 6, with piston rods 7 extending out of one end 8 thereof. An internally threaded sleeve 9 is mounted on the externally threaded end 8 of each cylinder 6. A disc or saddle 11 is provided on the outer end of each piston rod 7 for defining a large bearing surface. A bolt 12 (FIG. 2) extends outwardly from one side of the saddle 11 into a threaded bore (not shown) in the outer end of the piston rod 7. Hydraulic fluid is fed to and discharged from the other end 14 of the cylinders 6 from a source thereof (not shown) via a line 15 (FIG. 1), a coupler 16, a pipe cross 17, tube fittings 18, tubes 19 and elbows 20 (FIG. 2). In the embodiment of the invention illustrated in FIGS. 1 and 3, the tubes 19 are connected at one end directly to the pipe cross 17 and to the cylinders 6. It will be appreciated that FIGS. 1 and 3 are somewhat schematic, and that in most cases the hardware illustrated in FIG. 2 would be used. A handle 22 interconnects the ends 14 of the cylinders 6. The handle 22 includes discs 23 mounted on the cylinder ends 14 by means of bolts 24, and a rod 25 extending between the discs 23.

The threaded ends 9 of the cylinders 6 extend through holes 26 in opposite ends of a yoke 28. The yoke 28 is defined by a polygonal body 29 of aircraft aluminum. The cylinders 6 are retained in the body 29 by set screws 30 and by the sleeves 9. The pipe cross 17 is attached to the rear end of the body 29 by a pipe nipple 31. A handle 32 is mounted on the yoke 28. The handle 32 includes a base plate 33 (FIGS. 1 and 3) connected to the body by bolts 34, and a C-shaped bar 35. In the second embodiment of the invention (FIG. 2), the handle 32 is one-piece and generally C-shaped in cross section.

A socket defined by a recess or mortise 36 is provided in the front end of the body 29. The mortise 36 is in the shape of a truncated triangle, i.e. includes outwardly converging sides 37 for forming a dovetail-like connection with between the yoke 28 and a pair of jaws 38. The mortise 36 is covered by the handle 32.

Each jaw 38 is defined by a pair of virtually identical, generally S-shaped plates. The front arm 41 of the plates are interconnected at their centers by a web 42, which together with the plates defines a groove for receiving the shank 2 of the key 1. The arms 41 are generally L-shaped, defining hooks for engaging the head 4 of a key 1. The L-shaped rear arms of the plate include complementary generally triangular ends 44, which together form a wedge or tenon of the same shape as the mortise 36. Blocks 45 extending between the rear ends of the plates of one jaw 38 project outwardly for sliding between the plates of the other jaw. The block 45 of one jaw 38 is not aligned with the block of the other jaw, so that the jaws can slide completely together (FIG. 3). A reinforcing plate 47 extends between the rear ends of the arms 41 of each jaw.

Before being used, the jaws 38 are separate from the yoke 28 and from each other. The jaws 38 are separately placed on the head of the key 1, i.e. slide laterally onto the key 1 so that the jaws 38 engage the head 4 and the rear ends 44 of the jaw plates abut each other. The yoke 28 is then slid downwardly onto the jaws 38, so that the jaws are, in effect, wedged in the yoke 28. The handle 32 limits downward movement of the yoke 28 onto the jaws 38. Hydraulic fluid is introduced into the cylinders 6. Thus, the piston rods 7 are extended so that the saddles 11 press against the coupler (not shown) on each side of the key 1. As the piston rods 7 continue to be extended, the cylinders 6 move away from the coupler with the yoke 28 and the jaws 38. This action results in pulling of the key 1 from the coupler.

It will be appreciated that the key pulling operation is simple, being generally the same as described in the David W. Reesor earlier U.S. Pat. No. 5,129,133. The use of jaws which are initially separate from the yoke makes it relatively easy to mount the jaws on a key. The simple dovetail connection between the yoke and jaw, facilitates connecting and disconnecting of the various elements of the device.

We claim:

1. A device for removing a draft key including a shank and a head from a railway car coupler comprising a pair of fluid actuated cylinder means; yoke means interconnecting said cylinder means for maintaining the cylinder means in permanent parallel, spaced apart relationship; piston rod means extending outwardly from said cylinder means on one side of said yoke means; socket means in said one side of said yoke means; and separate jaw means for removable mounting in said socket means, and for receiving the head of a key, whereby the jaw means can be independently mounted on the head of a key and then placed in said socket means to connect the jaw means to said yoke means, and the piston rod means extended against the coupler to cause outward movement of said cylinder means, yoke means and jaw means to pull the key from the coupler.

2. The device of claim 1, including first handle means on said yoke means facilitating manual manipulation of the device.

3. The device of claim 2, including second handle means extending between the ends of said cylinder means remote from said yoke means.

4. The device of claim 1, wherein said socket means is trapezoidal, including outwardly converging sides and a narrow, open outer end, said jaw means including a pair of complementary forks, one end of said pair of forks filling said socket means when mounted therein.

* * * * *

UNITED STATES PATENT AND TRADEMARK OFFICE

CERTIFICATE OF CORRECTION

PATENT NO. : 5,701,649
DATED : Dec. 30, 1997
INVENTOR(S) : David Warren Reesor, et al It is certified that error appears in the above-identified patent and that said Letters Patent is hereby corrected as shown below:

On title page, item [54] and column 1, line 1, title of invention should read as follows:

--COUPLER DRAFT KEY PULLER--

Signed and Sealed this

Seventh Day of April, 1998

Bruce Lehman

*Attest:*

BRUCE LEHMAN

*Attesting Officer*

*Commissioner of Patents and Trademarks*